US008269647B2

(12) United States Patent
Solis

(10) Patent No.: US 8,269,647 B2
(45) Date of Patent: Sep. 18, 2012

(54) WELL DEPTH MEASUREMENT USING TIME DOMAIN REFLECTOMETRY

(75) Inventor: Vladimir Hernandez Solis, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1324 days.

(21) Appl. No.: 11/611,484

(22) Filed: Dec. 15, 2006

(65) Prior Publication Data

US 2007/0204686 A1 Sep. 6, 2007

Related U.S. Application Data

(60) Provisional application No. 60/773,546, filed on Feb. 15, 2006.

(51) Int. Cl.
*G01V 3/00* (2006.01)

(52) U.S. Cl. ..... 340/854.9; 324/519; 324/533; 73/152.57; 73/865.8

(58) Field of Classification Search ..... 73/152.57, 73/598, 623, 865.8; 324/519, 534, 539, 229, 324/239; 702/108; 708/426; 340/854.9
See application file for complete search history.

(56) References Cited

U.S. PATENT DOCUMENTS

| | | | | |
|---|---|---|---|---|
| 4,440,019 | A * | 4/1984 | Marshall | 73/152.56 |
| 4,650,131 | A * | 3/1987 | Droll et al. | 242/439 |
| 6,441,695 | B1 | 8/2002 | Flake | |
| 6,847,267 | B2 | 1/2005 | Flake | |
| 7,215,126 | B2 * | 5/2007 | Furse et al. | 324/534 |
| 7,375,602 | B2 | 5/2008 | Flake et al. | |
| 2004/0177681 | A1 * | 9/2004 | Harthorn et al. | 73/152.57 |
| 2004/0232919 | A1 * | 11/2004 | Lacey | 324/533 |
| 2005/0052190 | A1 * | 3/2005 | McCosh | 324/644 |
| 2005/0083062 | A1 * | 4/2005 | Couch | 324/337 |
| 2005/0274513 | A1 * | 12/2005 | Schultz et al. | 166/254.2 |
| 2006/0087323 | A1 * | 4/2006 | Furse et al. | 324/519 |
| 2008/0048669 | A1 * | 2/2008 | Scherber et al. | 324/534 |
| 2008/0317166 | A1 | 12/2008 | Flake et al. | |
| 2009/0147695 | A1 * | 6/2009 | Barkan et al. | 370/252 |
| 2009/0326826 | A1 * | 12/2009 | Hull et al. | 702/8 |

FOREIGN PATENT DOCUMENTS

| | | |
|---|---|---|
| EP | 0336025 | 12/1992 |
| GB | 2136241 | 9/1984 |
| GB | 2154742 | 9/1985 |
| GB | 2329722 | 3/1999 |
| GB | 2393465 | 3/2004 |
| JP | 4043935 | 2/1992 |

OTHER PUBLICATIONS

L. Brillouin, "Wave propagation and group velocity," NY: Academic Press, pp. 96, 1960.

R.H. Flake and J.F. Biskup, "Signal propagation without distortion in dispersive lossy media", 11th IEEE International Conference on Electronics, Circuits and System Proceedings, pp. 407-410, Dec. 2004, Tel-Aviv, Israel. ISBN 0-7803-8715-5.

(Continued)

*Primary Examiner* — Timothy Edwards, Jr.
(74) *Attorney, Agent, or Firm* — Michael Flynn; Jody DeStafanis

(57) ABSTRACT

A component is deployed into a well on a carrier line that includes an electrical cable. A depth of the component in a well is determined using a time domain reflectometry technique.

16 Claims, 4 Drawing Sheets

OTHER PUBLICATIONS

R.H. Flake, "Part I(Theory) Signal Propagation without Distortion on Lossy Transmission Lines Having Frequency Dependent Parameters", 9th IEEE Workshop on signal propagation on interconnects, pp. 43-45, May 2005, Garmish-Partenkirchen, Germany. ISBN 0-7803-9054.

Robert H. Flake and John Biskup, "Part II (Experiments) Signal Propagation without Distortion on Lossy Transmission Lines Having Frequency Dependent Parameters", 9th IEEE workshop on signal propagation on interconnects, pp. 51-54, May 2005, Garmish-Partenkirchen, Germany. ISBN 0-7803-9054-7.

Robert H. Flake and John Biskup, "Speedy Delivery Signal Propagation on Dispersive Lossy Transmission Lines", Proceedings of the IMAPS Advanced Technology Workshop on System Packaging 2004, pp. 101-102, Oct. 27-29, 2004, Palo alto, California.

Wang, S.J. et al., Advances in Test Technology for Metal Cables, slides summarizing a cable length measurement demonstration conducted during a seminar at Schlumberger, Sugar Land, Texas, Jun. 17, 2005, 27 pages.

Wang, S.J. et al., Advances in Test Technology for Metal Cables, slides for the oral presentation at the IEEE Central Texas Section of the ComSoc/SPSoc meeting in Austin, Texas, May 1, 2005, 44 pages.

* cited by examiner

WELL DEPTH MEASUREMENT USING TIME DOMAIN REFLECTOMETRY

CROSS-REFERENCE TO RELATED APPLICATIONS

This application claims the benefit under 35 U.S.C. §119 (e) of U.S. Provisional Application Ser. No. 60/773,546 entitled "Time Domain Reflectometry Method for Well Depth Calculation," filed Feb. 15, 2006, which is hereby incorporated by reference.

TECHNICAL FIELD

The invention relates generally to determining a well depth by measuring a length of an electrical cable using time domain reflectometry.

BACKGROUND

It is often desirable to determine the depth of a downhole component, such as a tool carried on a carrier line that has been deployed into a well. Typically, the carrier line is wound on a spool or reel at an earth surface location. To deploy a tool on the carrier line into the well, the carrier line is unwound from the spool.

Conventionally, a depth wheel sensor is provided at the earth surface location proximate the spool to determine an amount of carrier line that has been unwound from the spool. The depth wheel sensor includes a wheel or roller that is rotated as the carrier line is unwound from the spool. The number of rotations of the wheel is used to determine the length of the carrier line that has been unwound from the spool and lowered into a well.

This technique for measuring the length of carrier line that has been deployed into a well is not very accurate. As a carrier line is deployed into the well, the carrier line length will change due to environmental conditions (e.g., changes in temperature and/or pressure) and due to strain applied by the weight of the carrier line as well as the tool carried on the carrier line. The depth wheel sensor for measuring the length of carrier line that has been deployed into the well does not account for such length changes.

SUMMARY

In general, according to an embodiment, the method includes deploying a component into a well on a carrier line that includes an electrical cable, and determining a depth of the component in the well using a time domain reflectometry technique.

In general, according to another embodiment, a system includes an electrical cable for deployment into a well, and a measurement device electrically coupled to the electrical cable. The measurement device transmits an electrical pulse into the electrical cable, detects a reflected signal due to an impedance mismatch in the cable in response to the electrical pulse, and determines a length of the electrical cable based on the transmitted electrical pulse and the detected reflected signal.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

In accordance with some embodiments of the invention, a measurement device is used to transmit an electrical pulse into an electrical cable associated with a carrier line (e.g., an electrical cable in a wireline, an electrical cable in a slickline, an electrical cable deployed in tubing, and so forth) that is used to deploy a tool or other component into a well. The measurement device detects a reflected signal due to a downhole impedance discontinuity (or impedance change) in the carrier line, where the reflected signal is in response to the electrical pulse. The downhole impedance discontinuity can be at the most distal end of the electrical cable or at some other downhole location.

The overall travel time of the electrical pulse from a reference point at an earth surface location to the downhole impedance discontinuity, and of the reflected signal from the downhole impedance discontinuity back to the earth surface reference point, can be determined. This overall travel time is converted to distance (the estimated length of the electrical cable that has been deployed). Based on the measured length of the electrical cable that has been deployed into the well, the depth of a tool or other component can be determined. The above technique of transmitting an electrical pulse into an electrical cable and detecting a reflected signal for computing the length of the electrical cable is a time domain reflectometry (TDR) technique.

Figure 1:
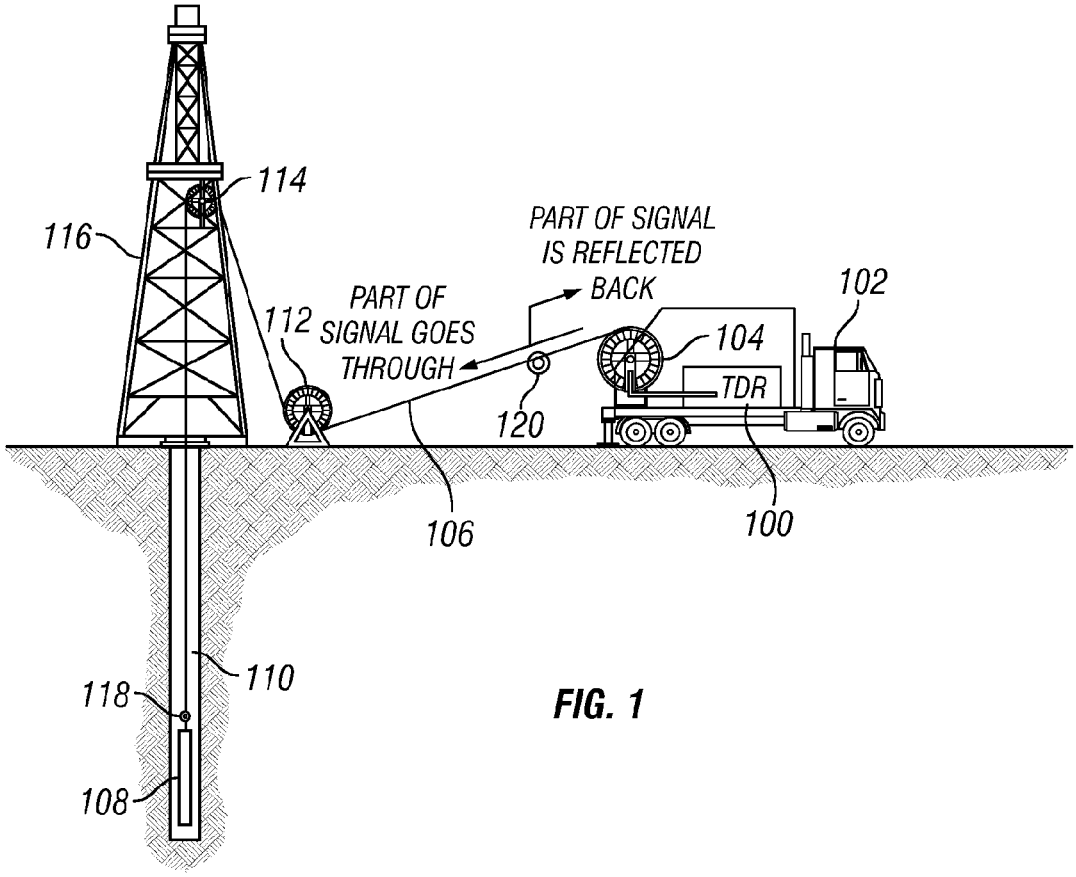
FIG. 1 illustrates a first exemplary arrangement that includes a measurement device according to some embodiments for determining a length of a carrier line deployed into a well.

FIG. 1 illustrates a first exemplary arrangement that includes a TDR measurement device 100 according to some embodiments. The measurement device 100 is depicted as being deployed on a vehicle 102. In other implementations, the measurement device 100 can be deployed on another platform (e.g., wellhead equipment either at a land well or a subsea well, a sea vessel, or other platform).

FIG. 1 also shows that the vehicle 102 includes a spool 104 that carries a carrier line 106. The remote (or distal) end of the carrier line 106 is attached to a tool 108. To deploy the tool 108 into a well 110, the carrier line 106 is unwound from the spool 104. The carrier line 106 is directed into the well 110 by sheaves 112 and 114 associated with wellhead equipment 116.

The carrier line 106 includes an electrical cable having a remote (or distal) end electrically coupled to the tool 108. The remote end of the electrical cable is associated with an impedance discontinuity (either a short circuit, an open circuit, or other impedance change). The remote end of the electrical cable thus forms a reference point 118. Another reference point 120 is defined at an earth surface location (discussed further below). In the ensuing discussion, the earth surface reference point 120 is referred to as a "first" reference point, and the downhole reference point 118 is referred to as a "second" reference point.

In an alternative implementation, instead of providing the second reference point 118 at the remote end of the electrical cable, it is noted that the second reference point 118 can be provided elsewhere along the electrical cable. Note that the second reference point 118 is the point in the well (corresponding to a location or depth of a tool or other component, for example) at which an electrical pulse transmitted down the electrical cable is reflected back up the electrical cable.

As further depicted in FIG. 1, the first reference point 120 is located proximate the output end of the spool 104 (the output end of the spool is the point of the spool at which the carrier line is unwound from the spool). The first and second reference points depicted in FIG. 1 allow the measurement device 100 to determine the length of the electrical cable between the first and second reference points. This length is used to derive the length of the carrier line 106 that has been unwound from the spool 104, and the depth of the tool 108 that has been deployed into the well 110.

The first reference point 120 includes a localized impedance change in the electrical cable at the earth surface. One technique of providing this localized impedance change is by heating and/or cooling one or more points of the electrical cable such that the impedance at the one or more points of the electrical cable is different from the positions of the electrical cable adjacent the heated/cooled point(s). In this manner, any electrical pulse generated by the measurement device 100 and transmitted into the electrical cable causes reflection from both the first and second reference points 120, 118. Although temperature change is one technique of causing a localized impedance change at the earth surface location proximate the spool 104, other techniques for causing the localized impedance change can be used.

When the electrical pulse generated by the measurement device 100 encounters the impedance change associated with the first reference point 120, a part of the electrical pulse is reflected back to the measurement device 100 as a first reflected signal. The remaining part of the electrical pulse continues into the electrical cable until it reaches the second reference point 118. As a result, a second reflected signal is generated that travels back to the measurement device 100.

The first reflected signal is used to determine the amount of electrical cable remaining on the spool 104, while the second reflected signal is used to determine the entire length of the cable, which includes the length of the electrical cable on the spool 104 and the length of the electrical cable that extends from the spool 104 into the well 110. The length of the electrical cable remaining on the spool 104 is then subtracted from the entire length of the electrical cable to determine the length of the electrical cable between the first and second reference points 120 and 118.

An issue associated with transmitting an electrical pulse into an electrical cable is that the electrical pulse may suffer dispersion and attenuation. Dispersion causes the electrical pulse length and shape to change, since dispersion causes the pulse length to increase. Attenuation causes the amplitude of the electrical pulse to be decreased. Note that the electrical cable is typically a dispersive and lossy medium that causes the dispersion and attenuation. As a result of dispersion and attenuation, it becomes difficult to detect reflected waveforms such that accuracy is adversely affected. Dispersion and attenuation of waveforms in the electrical cable results in a decline of spatial resolution in the TDR system. The spatial resolution of a TDR system is defined by the pulse length, amplitude, and shape of the transmitted electrical pulse.

Certain types of waveforms are subjected to dispersion, including quasi-sinusoidual waveforms. However, other types of waveforms do not suffer from dispersion even when propagating in dispersive media. One such waveform is an exponential waveform. Although the exponential waveform does suffer attenuation in a lossy medium such as the electrical cable, the shape of the pulse of the exponential waveform is preserved over the propagation path associated with the electrical cable. Since the exponential waveform does not broaden as a result of propagation along the electrical cable, the spatial resolution is relatively small (e.g., such as on the order of a few parts per million), to allow for accurate length measurement in different types of electrical cables.

In accordance with some embodiments, the TDR measurement device 100 that implements the TDR technique uses an exponential signal as the input electrical pulse. Such a TDR measurement device is referred to as a high spatial resolution TDR measurement device.

As noted above, FIG. 1 provides for a localized impedance change at the first reference point 120 that is caused by temperature change of the electrical cable. It is noted that a sudden change in the electrical properties of the insulation associated with the electrical cable (where the electrical properties include permittivity or permeability) may result in a strong enough reflection that the measurement device 100 can detect a reflected signal from the first reference point 120 and determine its position. Permittivity is a function of temperature. Therefore, changing the temperature at a given position along the electrical cable results in an impedance change.

Figure 2:
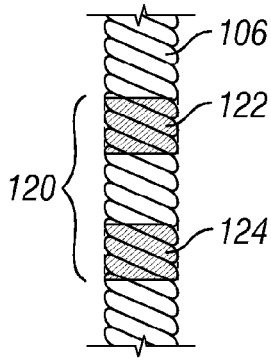
FIG. 2 illustrates positions on the carrier line subjected to temperature change to create an impedance mismatch at an earth surface location, in accordance with an embodiment.

FIG. 2 shows an example of the first reference point 120, where one position 122 of the electrical cable is subjected to heating (such as by a heater, not shown), and a second position 124 is subjected to cooling (e.g., by a cooling device, not shown). The first reference point 120 is thus associated with both a heated position and a cooled position to cause the impedance mismatch. In alternative implementations, the reference point 120 is only either heated or cooled (and not both).

Figure 3:
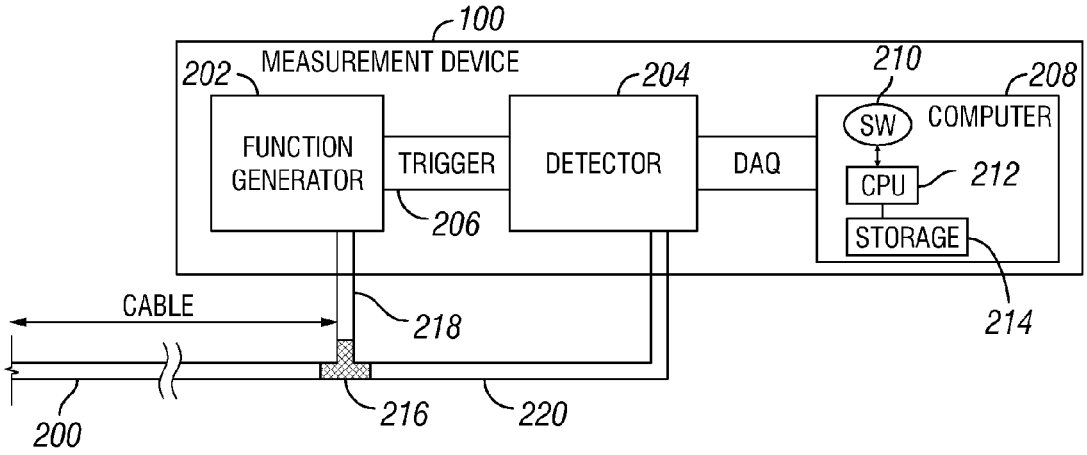
FIG. 3 is a block diagram of a measurement device setup according to an embodiment.

FIG. 3 shows a first setup for the measurement device 100. As depicted in FIG. 3, the measurement device 100 includes a function generator (signal generator) 202 for generating the waveform (electrical pulse) that is transmitted into an electrical cable 200 (such as the electrical cable in the carrier line 106). The measurement device 100 also includes a detector 204 (e.g., an oscilloscope) for detecting reflected signals in the electrical cable 200. A triggering signal 206 is provided between the function generator 202 and the detector 204 to allow the function generator 202 to trigger the detector 204 when the function generator 202 generates and transmits an electrical pulse into the electrical cable 200. Control of the function generator 202 and detector 204 is performed by a computer 208 (e.g., a portable computer). Also, the computer 208 performs data acquisition and processing according to some embodiments. The computer 208 includes software 210 that is executable on one or more central processing units (CPUs) 212, which CPU(s) 212 is (are) connected to a storage 214. The software 210 controls when the function generator 202 produces an electrical pulse for transmission into the electrical cable 106, and the software 210 is able to receive data relating to reflected signals (e.g., first and second reflected signals from the first and second reference points 120, 118) detected by the detector 204.

In the arrangement of FIG. 1, the detector 204 detects two reflected signals, a first reflected signal from the first reference point 120, and a second reflected signal from the second reference point 118. Data relating to these two reflected signals is received by the software 210, which can then estimate the length of the cable that has been deployed into the well 110 (estimated based on the length of the electrical cable between the first and second reference points). The software 210 can store the received data and the calculated length in a storage 214. Also, the computer 208 can output the various data associated with the TDR technique to the user, such as on a display. Alternatively, the computer 208 can send the data to a remote location, such as over a network (either a wireless network or a wired network).

The function generator 202 is connected to a directional coupler 216. The function generator 202 transmits an electrical pulse over a cable segment 218, which cable segment 218 is connected to one input of the directional coupler 216. The directional coupler 216 directs the electrical pulse from the cable segment 218 into the electrical cable 200. Any reflected signal that is reflected back from the electrical cable 200 passes through the directional coupler 216 to a second cable segment 220 that is connected to the detector 204.

Figure 4:
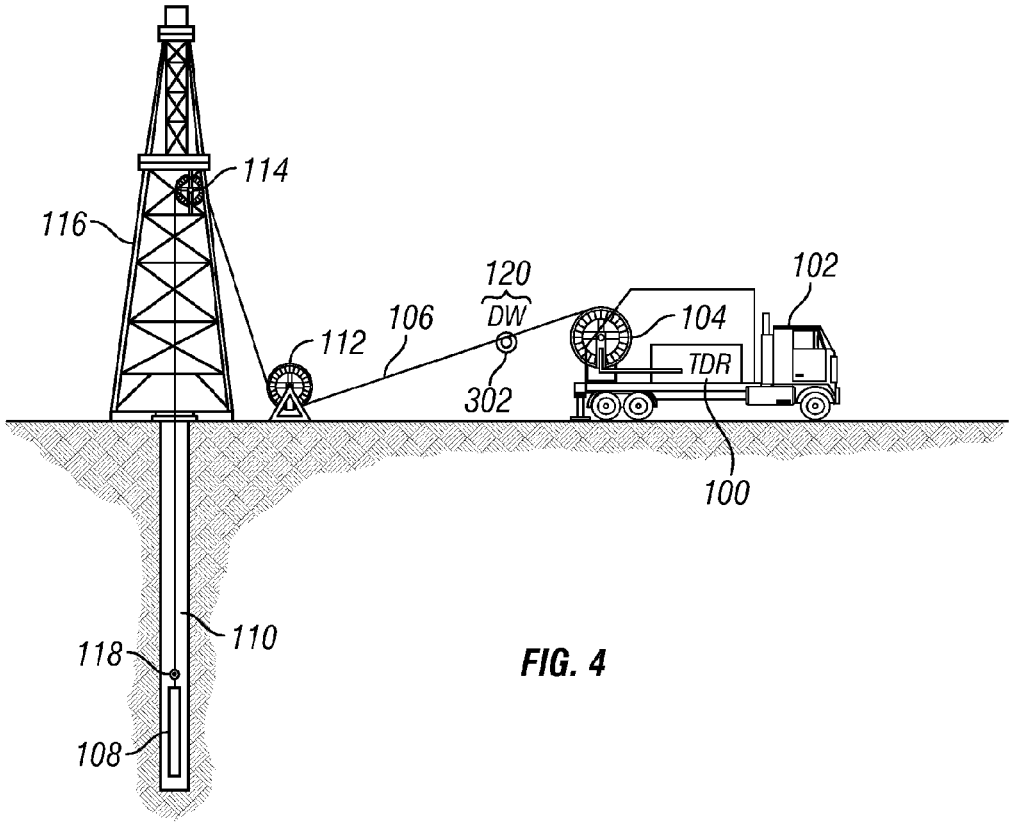
FIG. 4 illustrates a second exemplary arrangement that includes a measurement device according to some embodiments for determining a length of a carrier line that has been deployed into a well.

FIG. 4 shows an alternative arrangement that includes use of a wheel-based sensor 302 (e.g., an integrated depth wheel). Basically, the wheel-based sensor includes a roller or wheel that rotates as the carrier line is spooled or un-spooled. The wheel-based sensor 302 provides an output indication to indicate the amount of carrier line that has been unwound from the spool 104. The remaining components of the arrangement of FIG. 4 are identical to the components used in the arrangement of FIG. 1, and thus share the same reference numerals.

In the FIG. 4 arrangement, a localized impedance change at reference point 120 (in FIG. 1) is not provided. Instead, the wheel-based sensor 302 provides the first reference point 120 to allow the measurement device 100 to determine the amount of electrical cable remaining on the spool 104. With the technique of FIG. 4, the measurement device 100 sends an electrical pulse into the cable 200, which electrical pulse is reflected from second reference point 118 at the remote end of the electrical cable 200. The measurement device 100 measures the two-way travel time associated with the transmitted electrical pulse and the reflected signal to determine the total length of the electrical cable 200. The measurement device 100 then receives data from the wheel-based sensor 302 to determine the length of the electrical cable that remains on the spool 104. By subtracting the length of the cable remaining on the spool 104 from the total length of the cable 200, the measurement device 100 can determine the length of the cable between the wheel-based sensor 302 and the reference point 118, such that a depth of the tool 108 can be derived.

Figure 5:
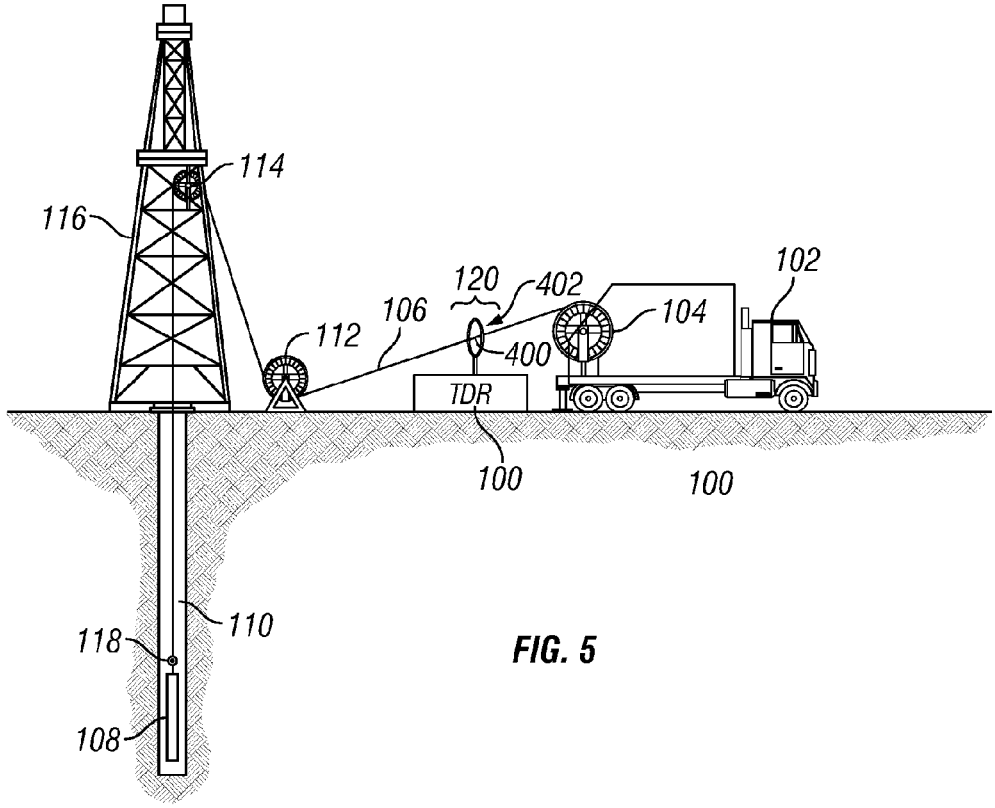
FIG. 5 illustrates a third exemplary arrangement that includes a measurement device according to some embodiments for determining a length of carrier line that has been deployed into a well.

FIG. 5 shows an alternative arrangement in which the spool 104 remains on the vehicle 102. However, the measurement device 100 has been re-positioned such that it is electrically coupled to a position on the electrical cable 106 that is proximate the output end of the spool 104. The position at which the measurement device is electrically coupled to the electrical cable is the first reference point 120. The electrical coupling between the measurement device 100 and the electrical cable 200 employs an inductive coupler mechanism 402. An inductive coupler mechanism uses electromagnetic coupling to couple electrical signaling on one electrical conductor onto a second electrical conductor. In one implementation, inductive coupling employs magnetic properties of steel used in the armor of an electrical cable.

Figure 6:
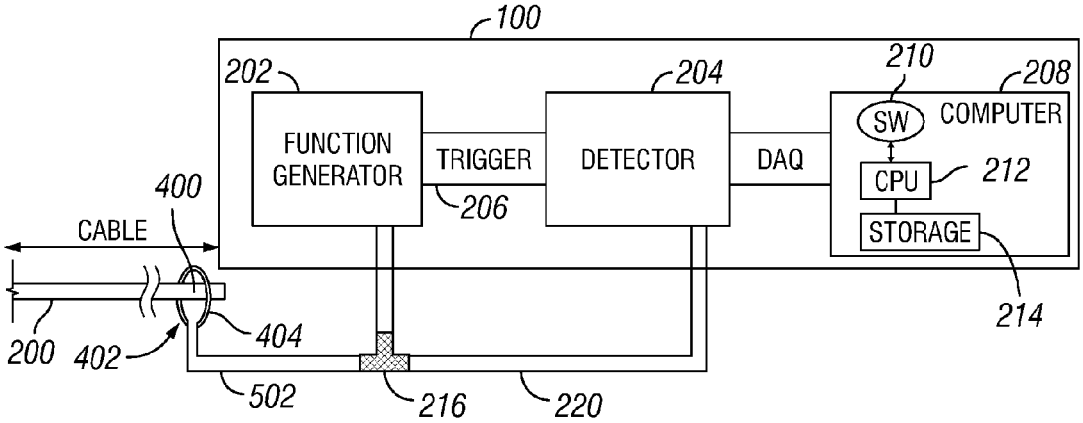
FIG. 6 is a block diagram of a measurement device setup according to another embodiment.

FIG. 6 shows the inductive coupler mechanism in greater detail. An electrical pulse generated by the function generator 202 is provided onto the cable segment 218, which is directed by the directional coupler 216 onto a cable segment 502. Note that the cable segment 502 is separate (physically distinct) from the electrical cable 200. The inductive coupler mechanism 402 includes a loop 404 that is provided around the electrical cable 200. The electrical pulse generated by the function generator 202 induces an electrical signal in the electrical cable 200 due to inductive coupling at point 400 on the electrical cable 200. The induced electrical signaling is then transmitted down the cable 200.

In the reverse direction, a reflected signal (such as the reflected signal from the remote end of the cable) travels back on the electrical cable 200 to point 400, where the reflected signal is inductively coupled onto the cable segment 502 and communicated to the detector 204 through the directional coupler 216 and cable segment 220.

Figure 7:
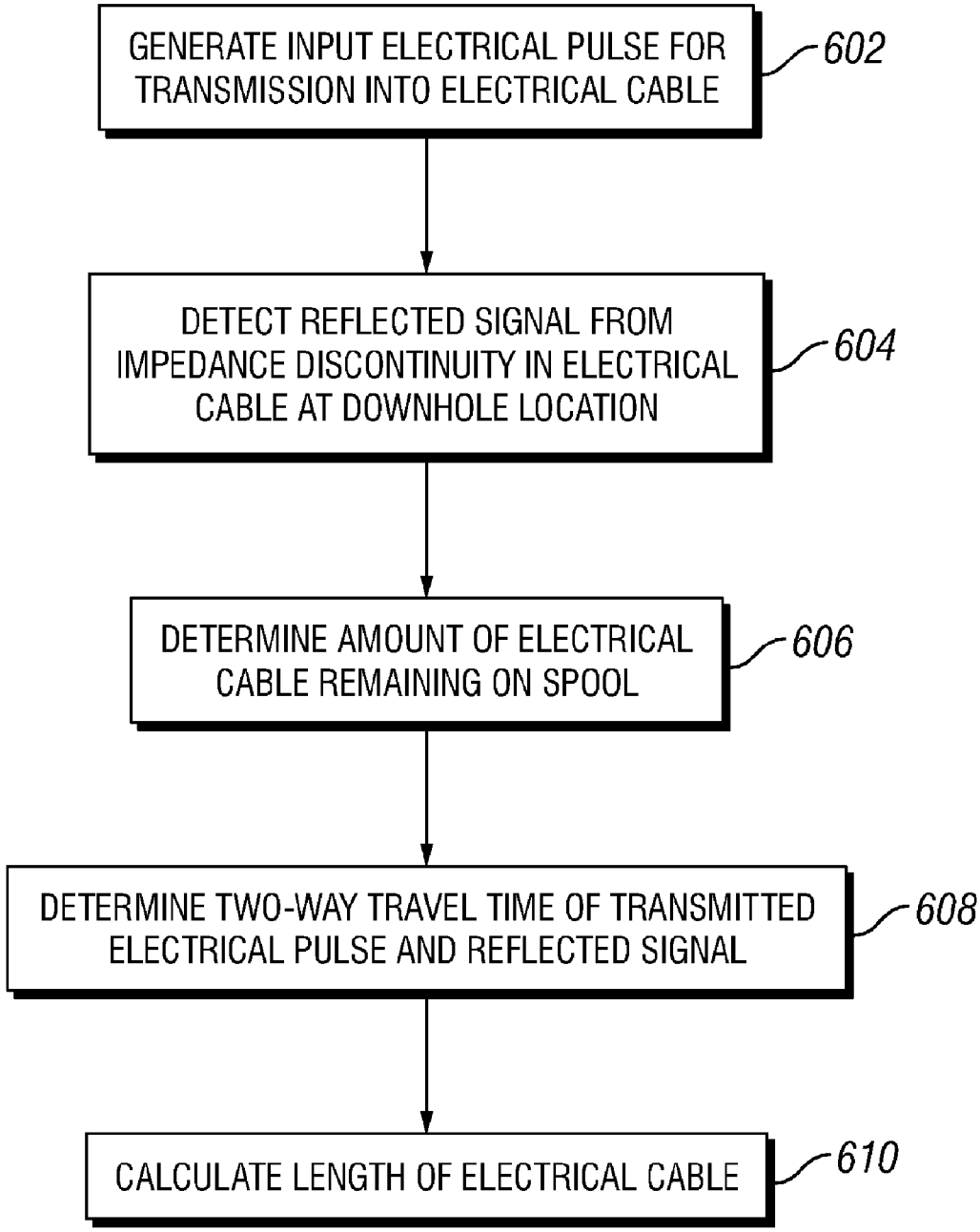
FIG. 7 is a flow diagram of a process performed by the measurement device according to an embodiment.

FIG. 7 is a flow diagram of a process performed by the measurement device 100, such as by the software 210 executable in the computer 208 of the measurement device 100. The measurement device 100 generates (at 602) an input electrical pulse (e.g., an exponential waveform or some other type of waveform) for transmission into the electrical cable 200 that is to be deployed into a well. The measurement device 100 detects (at 604) a reflected signal due to impedance discontinuity in the electrical cable at a downhole location, such as a distal end of the electrical cable 200 that is connected to a tool (e.g., tool 108 in FIG. 1).

If the first or second arrangement (FIG. 1 or FIG. 4 arrangement) is employed, the measurement device 100 also determines (at 606) the amount of cable remaining in the spool. As discussed above, there are several techniques of performing this determination, including providing a localized impedance change at a location (first reference point 120) proximate the output end of the spool, or by using a wheel-based sensor 302. If the third arrangement (FIG. 5 arrangement) is used, then the length of the cable remaining on the spool 104 does not need to be determined, since the reflected signal is received at a point (inductively coupled point 400 in FIG. 5) that is proximate the output end of the spool.

The measurement device next determines (at 608) the two-way travel time for the transmitted input electrical pulse in the reflected signal, where the two-way travel time refers to the sum of a first travel time between the function generator 202 and the second reference point 118, and a second travel time between the second reference point 118 and the detector 204 in the measurement device 100. Based on the two-way travel time, the measurement device 100 calculates (at 610) the length of the electrical cable that has been provided into the well. With the first and second arrangements of FIGS. 1 and 4, the deployed length is estimated by subtracting the length remaining on the spool from the total length of the cable (calculated based on the two-way travel time between the second reference point 118 and the measurement device 100). With the FIG. 5 arrangement, where the measurement device 100 is inductively coupled to a location on the cable that is proximate the output end of the spool, the length of the electrical cable calculated from the two-way travel time represents the length of the cable between the spool and the downhole location, so that subtraction of the length remaining on the spool 104 is not needed.

Instructions of software described above (including software 210 of FIGS. 3 and 6) are loaded for execution on a processor (such as one or more CPUs 212 in FIGS. 3 and 6). The processor includes microprocessors, microcontrollers, processor modules or subsystems (including one or more microprocessors or microcontrollers), or other control or computing devices.

Data and instructions (of the software) are stored in respective storage devices, which are implemented as one or more computer-readable or computer-usable storage media. The storage media include different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; and optical media such as compact disks (CDs) or digital video disks (DVDs).

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A method comprising:

deploying a component into a well on a carrier line that includes an electrical cable;

sending an electrical pulse into the electrical cable and detecting a reflected signal in response to the electrical pulse due to presence of a downhole impedance discontinuity in the electrical cable;

providing a first reference point at an earth surface location, wherein the downhole impedance discontinuity is associated with a second reference point located in the well, and wherein the first and second reference points enable determination of a length of the electrical cable between the first and second reference points;

providing the carrier line on a spool, wherein deploying the component into the well comprises unwinding the carrier line such that a segment of the carrier line is deployed into the well; and determining a length of the carrier line remaining on the spool based on the second reference point.

2. The method of claim 1, wherein sending the electrical pulse comprises sending an exponential waveform into the electrical cable, and wherein the detected reflected signal is in response to the exponential waveform.

3. The method of claim 1, wherein providing the first reference point at the earth surface location comprises providing a local impedance discontinuity at the first reference point, the method further comprising:

detecting a second reflected signal from the first reference point to determine the length of the carrier line remaining on the spool.

4. The method of claim 1, wherein providing the first reference point at the earth surface location comprises providing a wheel-based sensor at the first reference point, and wherein determining the length of the carrier line remaining on the spool comprises receiving an output from the wheel-based sensor.

5. The method of claim 1, wherein determining the depth of the component in the well is performed by software executable in a computer.

6. The method of claim 1, further comprising:

providing the carrier line on a spool, wherein deploying the component into the well comprises unwinding the carrier line such that a segment of the carrier line is deployed into the well; and providing a measurement device that is inductively coupled to a location on the electrical cable that is proximate an output end of the spool.

7. The method of claim 6, further comprising:

providing a signal generator and a detector in the measurement device, wherein the signal generator produces the electrical pulse that is inductively coupled onto the electrical cable, and wherein the detector receives a reflective signal that is inductively coupled from the electrical cable.

8. A system comprising:

an electrical cable for deployment into a well;

a spool to carry the electrical cable;

a measurement device electrically coupled to the electrical cable to:

transmit an electrical pulse into the electrical cable;

detect a first reflected signal due to an impedance discontinuity in the cable at a downhole location in the well in response to the electrical pulse; and determine a length of the electrical cable deployed into the well based on transmitting the electrical pulse and the detected first reflected signal, wherein a first reference point is defined at an earth surface location, wherein the impedance discontinuity defines a second reference point, and wherein the measurement device determines the length of the electrical cable based on the first and second reference points; and a wheel-based sensor at the first reference point to provide an indication, wherein the measurement device is configured to determine a length of the electrical cable remaining on the spool based on the indication from the wheel based sensor, and wherein the measurement device is configured to determine a two-way travel time of the electrical pulse and the first reflected signal, and to compute a total length of the electrical cable based on the two-way travel time, and wherein the determined length of the electrical cable deployed into the well is based on subtracting the length of the electrical cable remaining on the spool from the total length.

9. The system of claim 8, wherein the electrical pulse transmitted by the measurement device has an exponential waveform.

10. The system of claim 8, wherein the electrical cable is unwound from the spool to deploy into the well, wherein the measurement device is inductively coupled to a location on the electrical cable that is proximate an output end of the spool.

11. The system of claim 10, wherein the measurement device is configured to compute a two-way travel time that is a sum of a first travel time of the transmitted electrical pulse from the measurement device to the impedance discontinuity, and a second travel time of the first reflected signal from the impedance discontinuity to the measurement device, and wherein the length of the electrical cable is determined based on the two-way travel time.

12. The system of claim 8, wherein the first reference point is defined by a temperature change of the electrical cable that causes an impedance change at the earth surface location, wherein the measurement device is configured to detect a second reflected signal reflected from the first reference point in response to the transmitted electrical pulse; and wherein the determined length of the electrical cable deployed into the well is based on the first and second reflected signals.

13. The system of claim 12, further comprising:

a spool to carry the electrical cable, wherein the electrical cable is unwound from the spool to deploy into the well, wherein the measurement device is configured to calculate a length of the electrical cable remaining on the spool based on the second reflected signal.

14. The system of claim 13, wherein the measurement device is configured to calculate a total length of the electrical cable based on the first reflected signal;

wherein the determined length of the electrical cable deployed into the well is based on subtracting the length of the electrical cable remaining on the spool from the total length of the electrical cable.

15. A measurement device to measure a length of an electrical cable deployed into a well, comprising:

a signal generator to transmit an electrical pulse into the electrical cable that is deployed into the well;

a detector to detect a first reflected signal in response to the transmitted electrical pulse as a result of an impedance discontinuity in the electrical cable at a downhole location in the well; and a computer to compute a length of the electrical cable deployed into the well based on the transmitted electrical pulse and the detected first reflected signal, wherein the electrical cable is spooled on a spool, and wherein the computer is configured to determine an amount of the electrical cable remaining on the spool to enable the computation of the length of the electrical cable deployed into the well.

16. The measurement device of claim 15, wherein the transmitted electrical pulse has an exponential waveform that is not subject to dispersion by the electrical cable.

* * * * *